US005205329A

United States Patent [19]

Suzuki et al.

[11] Patent Number: 5,205,329

[45] Date of Patent: Apr. 27, 1993

[54] WIRE HARNESS AND METHOD OF AND APPARATUS FOR MANUFACTURING THE SAME

[75] Inventors: Yoshitsugu Suzuki; Shougo Iizuka; Shigeo Kajiyama; Sanae Suzuki; Shigeji Kudo; Toshihiro Inoue; Norio Isobe; Yoshihisa Oosumi, all of Gotenba, Japan

[73] Assignee: Yazaki Corporation, Tokyo, Japan

[21] Appl. No.: 744,684

[22] Filed: Aug. 9, 1991

Related U.S. Application Data

[63] Continuation of Ser. No. 271,970, Nov. 16, 1988, abandoned.

[30] Foreign Application Priority Data

| | | | |
|---|---|---|---|
| Nov. 17, 1987 | [JP] | Japan | 62-288353 |
| Nov. 17, 1987 | [JP] | Japan | 62-288354 |
| Nov. 17, 1987 | [JP] | Japan | 62-288355 |
| Nov. 17, 1987 | [JP] | Japan | 62-288356 |
| Nov. 17, 1987 | [JP] | Japan | 62-288357 |

[51] Int. Cl.[5] ..... B21F 27/00

[52] U.S. Cl. ..... 140/92.1; 29/755

[58] Field of Search ..... 29/850, 868, 748, 755; 140/92.1; 361/426, 428; 174/72 A

[56] References Cited

U.S. PATENT DOCUMENTS

| | | | |
|---|---|---|---|
| 1,926,927 | 9/1933 | Woertz | 361/426 |
| 3,859,724 | 1/1975 | Folkenroth | 29/755 |
| 4,060,890 | 12/1977 | Dechelette et al. | 29/748 |
| 4,171,862 | 10/1979 | Krasser | 361/426 |
| 4,306,697 | 12/1981 | Mathews | 248/68 |
| 4,476,629 | 10/1984 | Suzuki et al. | 29/863 |
| 4,700,913 | 10/1987 | Hirano et al. | 248/73 |
| 4,734,965 | 4/1988 | Schaefer | 29/755 |
| 4,781,227 | 11/1988 | Cross | 140/92.1 |

FOREIGN PATENT DOCUMENTS

| | | |
|---|---|---|
| 0123412 | 11/1984 | European Pat. Off. . |
| 884296 | 12/1961 | United Kingdom . |
| 1258501 | 12/1971 | United Kingdom . |
| 1289368 | 9/1972 | United Kingdom . |
| 1347281 | 2/1974 | United Kingdom . |
| 1458143 | 12/1976 | United Kingdom . |
| 1560825 | 2/1980 | United Kingdom . |

*Primary Examiner*—Lowell A. Larson

*Attorney, Agent, or Firm*—Nikaido, Marmelstein, Murray & Oram

[57] ABSTRACT

A wire harness and a method of and apparatus for manufacturing the same is disclosed. The present wire harness comprises a plurality of electric wires, constituting its trunk line portion and branch line portions, laid on a wiring board so as to form a desired pattern and a clamp chain, formed of a plurality of wire clamps arranged in parallel at predetermined pitches, attached to the edge portion at least at one side of the wiring board, in which the electric wires are locked to specific wire clamps of the clamp chain, and thereby, both end portions of the electric wires are arranged so as to be in parallel at predetermined pitches and projecting from the edge portion.

7 Claims, 11 Drawing Sheets

WIRE HARNESS AND METHOD OF AND APPARATUS FOR MANUFACTURING THE SAME

This application is a continuation of application Ser. No. 271,970 filed Nov. 16, 1988, now abandoned.

BACKGROUND OF THE INVENTION

The present invention relates to a wire harness made up of a plurality of electric wires formed in a desired pattern and arranged for ease of terminal processing such as stripping the wire and press-joining the same with a terminal material as well as method of and apparatus for manufacturing the same.

A wire harness generally has a two-dimensional configuration, as shown in FIG. 6, constituted of a trunk line portion $W_0$ formed of a bundle of a plurality of wires $a_1$, $a_2$, . . . and a plurality of branch line portions $W_1$, $W_2$, $W_3$, . . . branched to correspond to a distribution of various loads and groups of electric equipages such as switches on a motor vehicle, each wire being connected at the end thereof with a terminal b, which is further provided with a connector housing c mounted thereon.

The present applicant proposed a method of and apparatus for manufacturing such a wire harness (Japanese Patent Application No. 57-9081, U.S. Pat. No. 4,476,629 specification). In this method, a plurality of wiring boards $d_1$, $d_2$, . . . are arranged at the first on a working board e at relative positions of products as indicated by connector housings c in FIG. 6 and also pins f for laid wires to engage therewith are vertically embedded therein. The wire is first locked for example to a wiring board $d_1$, then the wire is laid to another wiring board $d_2$ by means of a wiring head (not shown) scanning the working board (along both X-axis and Y-axis), and the wire is locked to the wiring board $d_2$ and cut at a distance therefrom. After wires have been laid between desired wiring boards in succession, the ends of the wires are subjected to stripping and press-joining process with terminal metallic materials at the positions near the wiring boards $d_1$, $d_2$, . . . .

However, with the above described method, there occur various problems as follows.

(1) The device for stripping the wire and the device for press-joining the wire with a terminal material are required for the ends of laid wires in scattered positions.

(2) When the specification of products is changed, all of the wiring boards, wire engagement pins, stripping devices, and so on must be moved and therefore much time and labor are required for the new setup.

(3) Since the terminals on which the connector housings are to be mounted are scattered as shown in FIG. 6, automation therefor is difficult.

(4) Since the stripping devices, terminal press-joining devices, and so on that are required are large in number, the initial cost is high and maintenance control is difficult.

SUMMARY OF THE INVENTION

The present inventors completed this invention based on the novel idea obtained as a result of their strenuous studies directed to overcoming the above enumerated difficulties that a wire harness, in which ends of wires are not necessarily arranged two-dimensionally as the aforesaid relative positions of products but arranged linearly at one side of the wiring board, will be obtained by laying wires such that the middle portions of branch line portions $W_1$, $W_2$, $W_3$, . . . separated into groups are laid to make suitable detours by means of pins as shown in FIG. 1*a*.

Accordingly, an object of the present invention is to provide a wire harness in which both ends of the wires forming the wire harness are locked at, for example, one edge portion of a wiring board, arranged at predetermined pitches and projecting from the edge portion, whereby terminal processing for the wires is facilitated and manufacturing cost of the wire harness is decreased.

Another object of the present invention is to provide a method of and apparatus for manufacturing a wire harness, whereby various terminal processing devices, such as a terminal press-joining device, for processing a plurality of wires constituting the wire harness after being wired can be greatly reduced in number, automation of mounting the connector housings is made easy, changes in wiring paths are quickly coped with, and consequently manufacturing cost of the wire harness is reduced.

A further object of the present invention is to provide an apparatus, wherein the wiring head for laying the wire is adapted to reciprocate in the direction along Y-axis, while the wiring board is moved in the direction along X-axis, and thereby the structure of the wiring head itself is simplified and selection of the kind of the wire to be laid is made easier, and further, the laying work of the wires can be carried out more safely.

Still another object of the present invention is to provide wire clamps suitable for holding the ends of the laid wires in such a manner that the ends projects from the edge portion at least at one side of the wiring board and are arranged in parallel at predetermined pitches.

Other objects and features of the present invention will be more fully described below with reference to the accompanying drawings wherein certain embodiments of the present invention are illustrated.

DESCRIPTION OF THE PREFERRED EMBODIMENTS

Figure 1A:
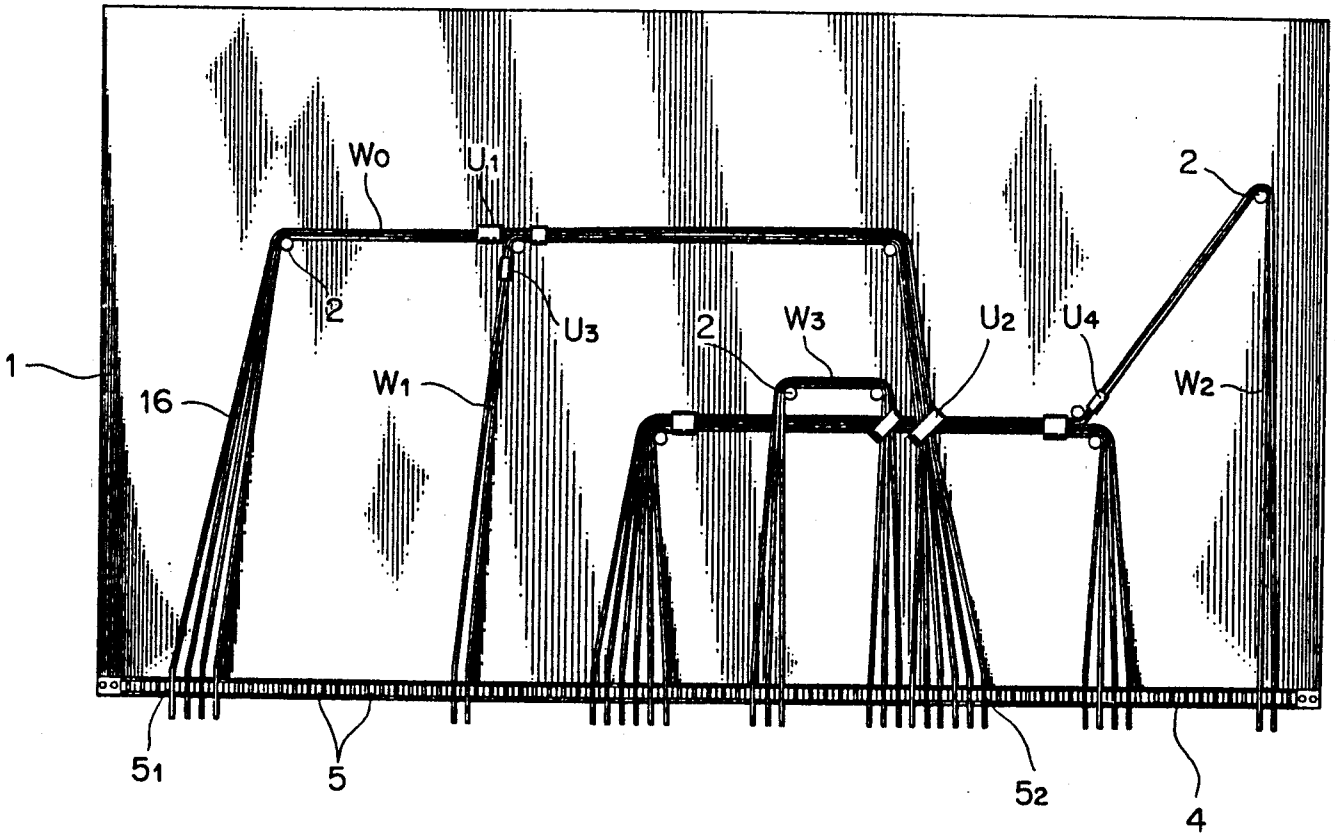
FIG. 1*a* is an explanatory drawing of a wire harness and a method of manufacturing the same according to the present invention.

The wire harness according to the present invention is characterized in that it is provided, as shown in FIG.

1*a*, by laying a large number of electric wires 16, forming a trunk line portion $W_0$ and branch line portions $W_1$, $W_2$, . . . of the wire harness, on a wiring board 1 in a desired pattern, wherein both ends of the wires are arranged in parallel at predetermined pitches and locked to the edge portion at least at one side of the wiring board in such a manner that the ends project from the edge portion.

The locking of the wires is preferably performed by means of a clamp chain 4 formed of a plurality of wire clamps 5 arranged in parallel and fixedly or detachably attached to the edge portion of the wiring board 1, and the laying of the wires is advantageously performed by laying the wires turning at a plurality of pins 2 vertically embedded in the wiring board 1.

The method of manufacturing the wire harness according to the present invention is characterized, as shown in FIG. 1*a*, in that, in the manufacture of a wire harness made up of a plurality of wires 16, with a clamp chain 4 formed of a plurality of wire clamps 5 arranged in parallel at predetermined pitches provided, the wires 16 are laid or stretched between desired wire clamps, for example wire clamps $5_1$ and $5_2$, and both end portions thereof are locked to the wire clamps such that the end portions of the wires project therefrom.

Figure 1B:
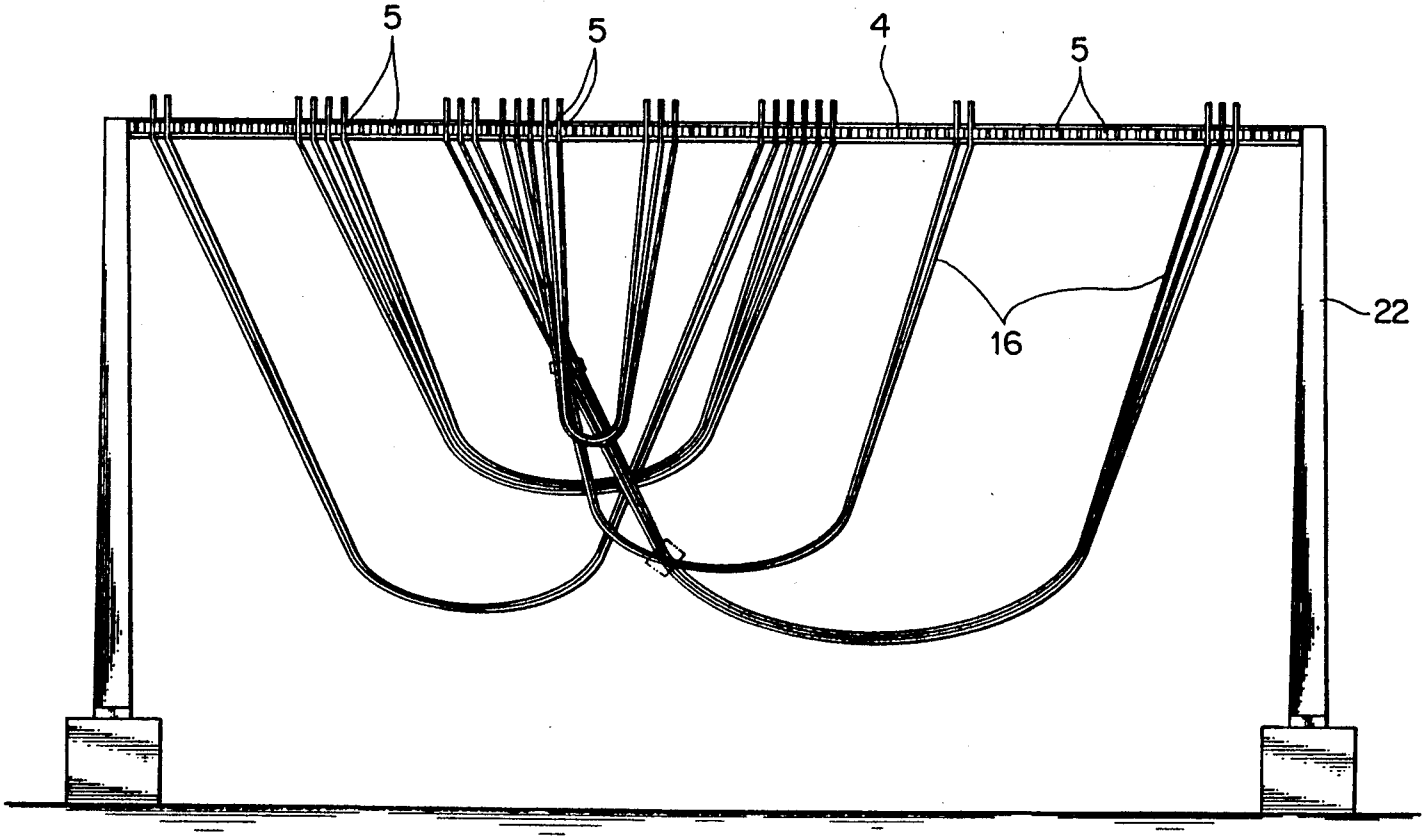
FIG. 1*b* is an explanatory drawing of a state of the wire harness kept in stock.

The wire laying can be carried out manually or semi-automatically on a wiring board 1 with a plurality of pins 2 vertically embedded therein. Further, since the wires 16 forming the trunk line portion $W_0$ and the branch line portions $W_1$, $W_2$, . . . of a wire harness can be divided into specific groups according to their lengths and for convenience of mounting of the connector housing, a wire harness can also be manufactured, as shown in FIG. 1*b*, not using the wiring board 1, but using the clamp chain 4 mounted on a mount 22, and simply hanging the wires 16 from desired pair of wire clamps such that the wires form loops and locking them at both ends thereof.

The wires to be laid may be either those previously cut to specific lengths or that of a long size. Locking and cutting of the wire may be carried out either by locking one end first and locking the other end after laying the wire, or by holding the wire with a jig, not shown, at the time of laying, and, after the laying has been finished, locking both ends of the wire to the wire clamps and then cutting them. What is essential is that the end portions of the laid wires are arranged in parallel at one side of the wiring board 1 by means of the clamp chain in such a way that a predetermined length of the wires are projecting in one direction. It is also advantageous to arrange such that the laid wires together with the clamp chain can be removed from the wiring board.

Further, the manufacture of the wire harness can be automated according to a method by the use of a wiring board having a clamp chain provided at its edge portion at one side, the clamp chain being formed of a plurality of wire clamps arranged in parallel at predetermined pitches, and a plurality of pins vertically embedded in its central portion and of a wiring head traveling over the wiring board comprising the steps of:

a. laying an electric wire from a first wire clamp selected from the clamp chain to a second clamp turning at the plurality of pins disposed corresponding to a predetermined path;

b. locking each of ends of the electric wire laid down to the first and second wire clamps, respectively, and cutting the wire according to the need; and c. repeating the steps a. to b., thereby laying electric wires between predetermined wire clamps such that the wires form a desired predetermined pattern, and locking the same to the wire clamps, as set forth in claim 8.

As the wiring head, that of known structure (specification of U.S. Pat. No. 4,476,629) traveling in the directions along X-axis and Y-axis over the wiring board, or one using a wiring head making movement in the direction along Y-axis relative to a wiring board making movement in the direction along X-axis in combination can be used.

As an apparatus for automating the manufacture of a wire harness may be used an apparatus comprising a wiring board having a clamp chain provided at its edge portion at one side, the clamp chain being formed of a plurality of wire clamps arranged in parallel at predetermined pitches, and a plurality of pins vertically embedded in its central portion, a wiring head holding an electric wire paid out from a reel station and traveling over the wiring board, a means for locking the laid electric wire to the wire clamps and cutting the same, and a control means for controlling the path along which the wiring head travels.

The wire harness according to the present invention is constructed of wires both ends thereof are clamped by wire clamps of a clamp chain at predetermined pitches and projecting from one end thereof.

Hence, when the wire harnesses have been manufactured by the use of the wiring board and the clamp chain, the wire harness and the clamp chain in combination can be removed from the wiring board, and therefore, they can be stored in a storehouse as they are for future use and, when it becomes necessary according to production schedule or the like, they can be subjected to such processing as striping the wire and press-joining a terminal material therewith. Since the laying of wires need not be suspended during the time of such terminal processing, high productivity can be obtained.

Further, by arranging such that the clamp chain is transferred to a station next to or separate from the wiring board and placing such working apparatuses as a wire stripping device, sensor, terminal joining press at one side of the clamp chain, all the wires can be successively processed automatically by one each of such devices for being stripped and press-joined with terminal materials, or further, for being provided with connector housings mounted thereon.

Figure 6:
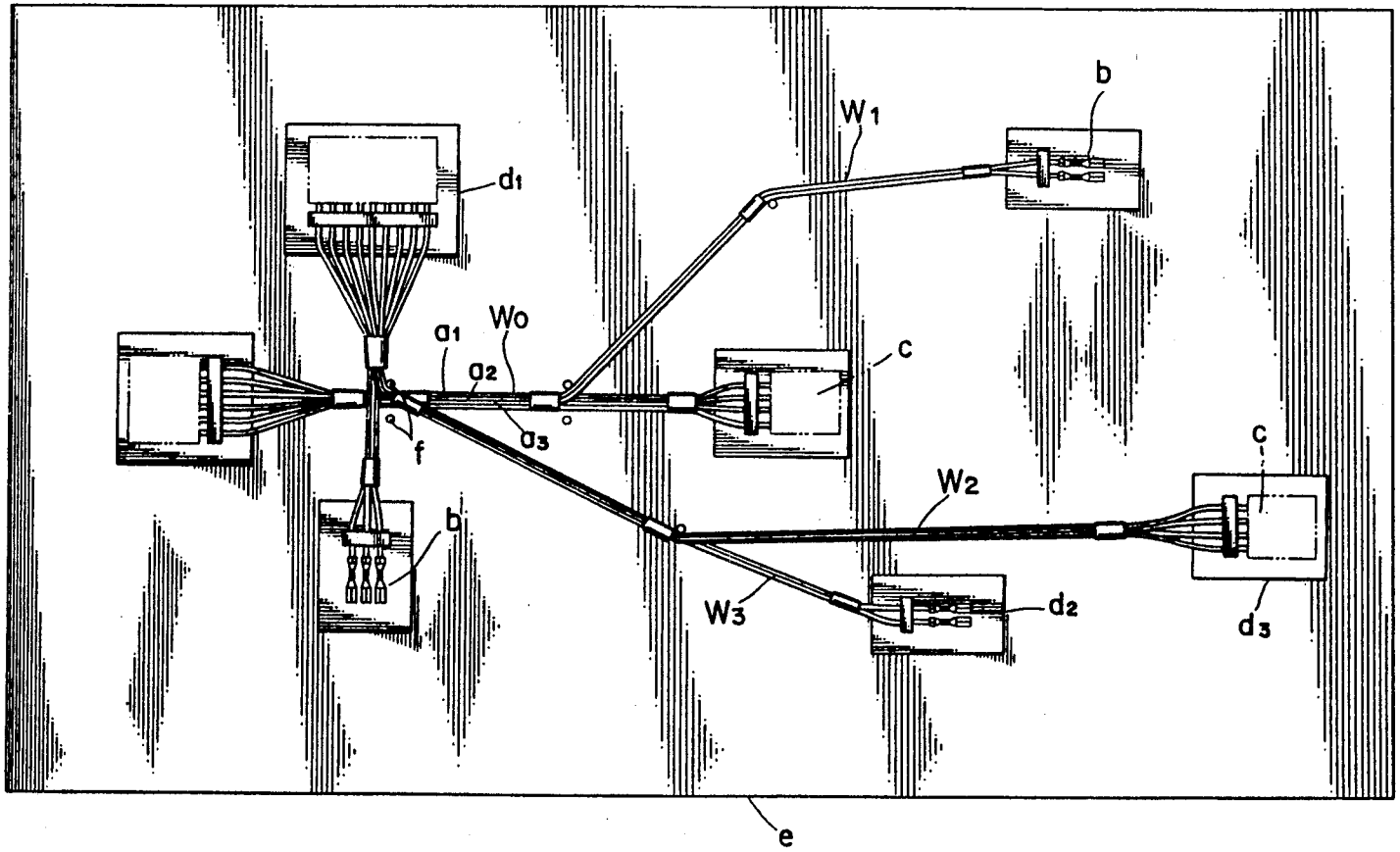
FIG. 6 PRIOR ART
FIG. 6 is an explanatory drawing showing a prior art manufacturing method of a wire harness.

In laying down the wires, by distributing a plurality of pins 2 suitably spaced apart, the trunk line portion $W_0$ and the branch line portions $W_1$, $W_2$, $W_3$, . . . of the wire harness can be clearly separated as shown in FIG.1*a*. Further, the wires forming the branch line portions $W_1$, $W_2$, $W_3$, . . . can be separated from one another by selecting adjoining wire clamps 5 of the clamp chain 4 as a group for each thereof. Hence, by winding a tape around each of important positions of the laid wires, for example positions $U_1$, $U_2$ of the trunk line portion and positions $U_3$, $U_4$, . . . of the branch line portions, a wire harness in a two-dimensional arrangement quite similar to that of the prior art shown in FIG. 6 can be obtained. Selection of the wire clamps 5 and the pins 2 for determining the wiring paths is performed according to a program input to a later described control for controlling the wiring head.

When specification of the wire harness is changed, what is required is only to move the pins 2 and to change the program, and since there is no change made in the state of the laid wires both ends thereof are all held arranged in parallel at one side of the wiring board. Hence, the working devices such as wire stripping device can be used as they are.

Further, by adapting the wiring board 1 to travel in the direction along the length of the clamp chain 4 (X-axis) and the wiring head to travel only in the direction along Y-axis, their arrangement can be simplified. Further, differing from the case with the prior art X-Y axial traveling type wiring head, the need has been eliminated for moving the wiring head vertically and horizontally over the wiring board with a wire held thereby, and hence, the wire supply is performed smoothly and the wire supply mechanism can be simplified. Furthermore, there is no need for having various kinds of wires in diameter and color of insulation covering constantly held by the wiring head, but wiring can be performed with a wire of a desired specification easily selected the wiring head as described later.

The present invention will be described in a more concrete manner with reference to FIG. 2 to FIG. 5.

Figure 2A:
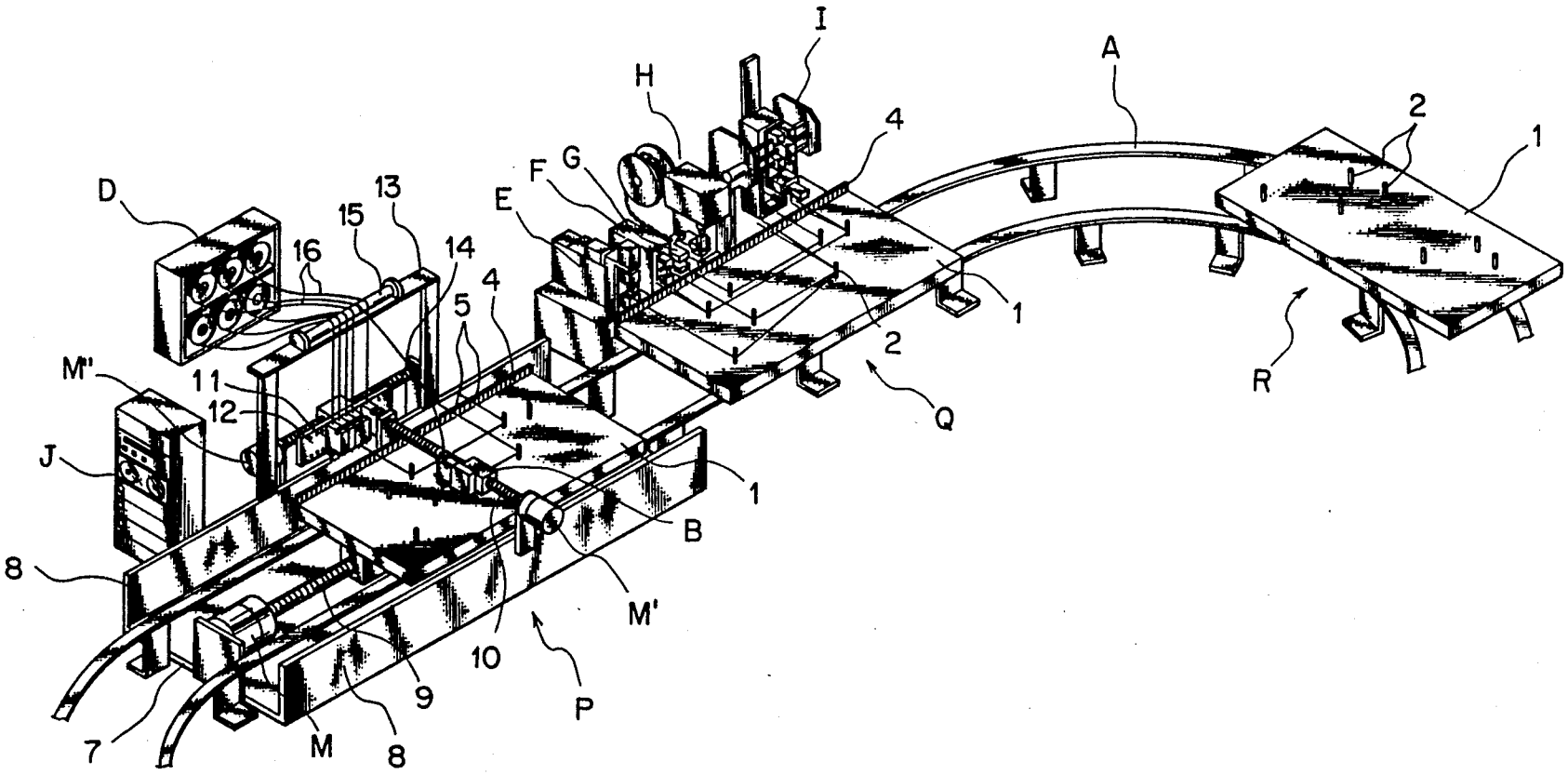
FIG. 2*a* is a schematic perspective view showing an example of an apparatus embodying the present invention.

Referring to FIG. 2*a*, A denotes a endless transport rail stand, and the wiring board 1 movably mounted thereon is provided with a plurality of pins 2 vertically embedded in the central portion thereof and with the clamp chain 4, having a plurality of wire clamps 5 linearly arranged in parallel, fixed at one side thereof in the longitudinal direction.

Reference character P denotes a wiring station for laying wires, Q denotes a terminal processing station for the wires, and R denotes a removal station of the laid wires (wire harness).

In the station P, the transport rail stand A is protected at both sides thereof by safety guides 8. The wiring board 1 is disposed inside the guides 8 for reciprocating movement in its longitudinal direction (X-axis) by means of a ball-screw shaft 9 rotated by a controlled-rotation motor M. Reference character B denotes the wiring head for laying the wire and arranged to be reciprocally movable in the direction (Y-axis) perpendicular to the wiring board 1 by rotation of a ball-screw 10 placed between the safety guides 8, 8. Reference character M′ denotes a controlled-rotation motor for the same. There are also disposed a wire locking and cutting device C (refer to FIG. 4) and a plurality of wire holders 11, 11′, . . . confronting the clamp chain 4 on the wiring board 1. Reference numeral 12 denotes a support plate for the wire holders 11 and is adapted to reciprocate in the direction along X-axis by means of a ball-screw shaft 14 mounted on a gate mount 13 erected on the safety guide 8, whereby the wiring head B is made possible to select a desired wire holder 11. The amount 13 is provided thereon with a plurality of wire feed rolls 15, whereby a plurality of wires 16 different in diameter and color of insulating coverings paid out from a wire reel station D can be smoothly supplied. Here, reference character M″ denotes a controlled-rotation motor for the ball-screw shaft 14.

In the station Q, there are sequentially disposed, in confronted relation with the clamp chain 4 on the wiring board 1, a wire straightening device E, wire stripping device F, sensor device G, terminal press-joining device H, and case mounting device I. As such devices, known devices can be utilized. The mounting of the connector housing can be automated by the use of the case mounting device I.

Reference character J denotes a control which, as described later, controls a sequence of manufacturing processes of the wire harness consisting of laying wires carried out by the wiring board 1 traveling in the direction along X-axis and the wiring head B traveling in the direction along Y-axis, and processing done by the wire locking and cutting device C, terminal press-joining device G, case mounting device I, and so on.

Figure 2B:
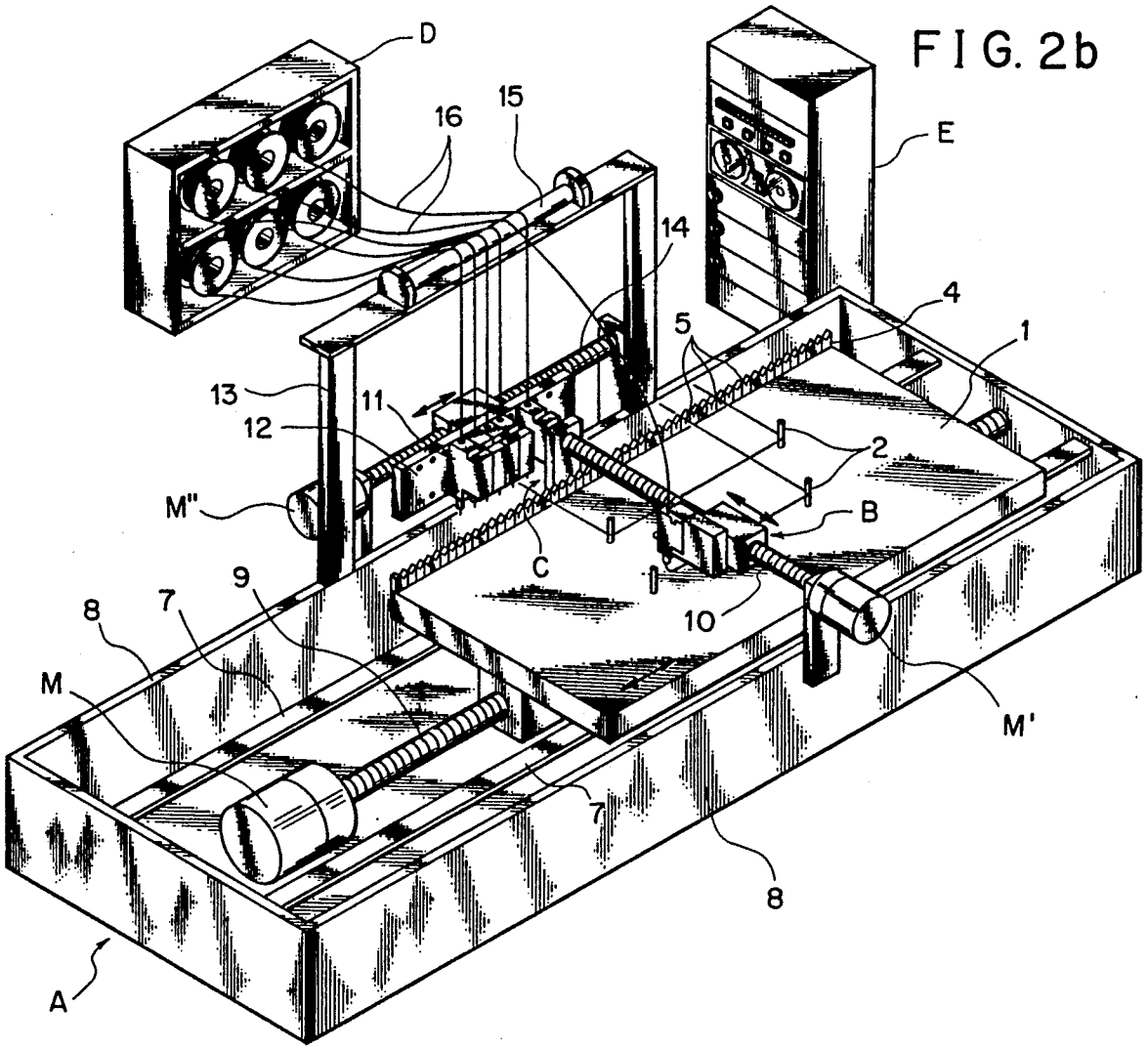
FIG. 2*b* is a schematic perspective view showing another example of an apparatus similarly embodying the present invention.

In FIG. 2*b* is shown only the wiring station for laying wires P′ separated from the terminal processing station Q for the wires and the removal station R of the wires. Referring to the figure, reference character A′ denotes a base stand for supporting a pair of rails 7 thereon, J′ denotes a control, similar to the aforesaid control J, for controlling the traveling of the wiring board 1 and the wiring head B, operation of the wire locking and cutting device C, and so on. The clamp chain 4 is detachably attached to the wiring board 1. Other reference characters denote corresponding parts to those in FIG. 2*a*.

Figure 3A:
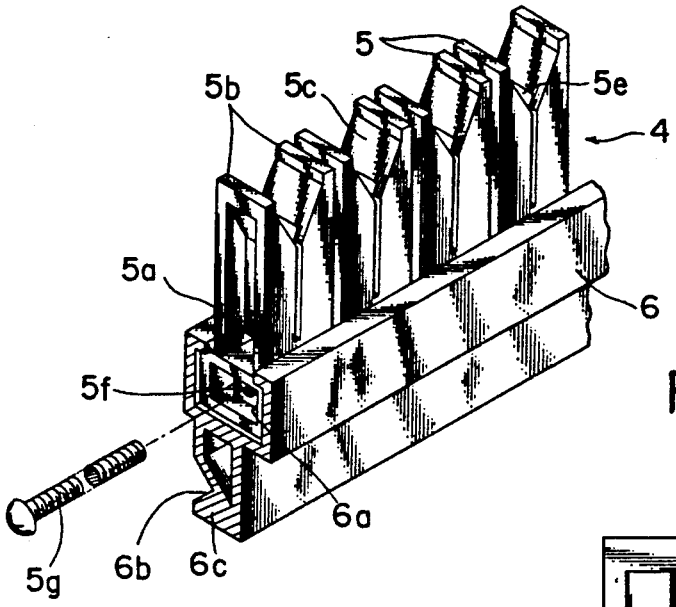
FIG. 3*a* is an enlarged perspective view of a clamp chain 4.
Figure 3B:
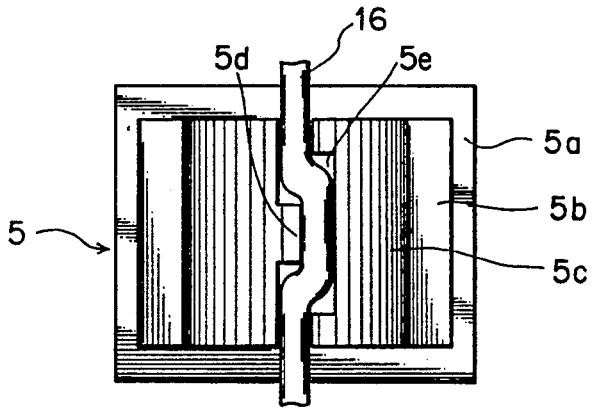
FIG. 3*b* is a plan view of a wire clamp.

With reference to FIG. 3*a* and FIG. 3*b*, the clamp chain 4 used is preferably provided by arranging a plurality of wire clamps 5 in parallel at a predetermined pitches by means of a long support bar 6. The wire clamp 5 is made of synthetic resin, metal, hardened rubber, or the like, and constructed of a pair of fastening members 5*b*, 5*b* erected on a base portion 5*a* in a square beam form. The fastening members 5*b* have at their upper portions slanted guide faces 5*c* with space therebetween widened toward the top end, and further, at their lower portions facing each other, one face thereof is provided with a projected strip 5*d* while the other face thereof is provided with a groove 5*e*. Thus, it is adapted such that a wire is easily inserted in between and tightly pinched by these members. Through the base portion 5*a*, there is made a through hole 5*f* and a number of wire clamps 5 are coupled together by means of a screw pin or the like passed through the through hole 5*f*. The support bar 6 is structured such that, under its insertion frame 6*a* for the base portion 5*a*, there is projected therefrom a support leg 6*c*, and at one side face of this support leg 6*c*, there is made a horizontally running V-formed fastening groove 6*b*. The support leg 6*c* is inserted in an engagement groove, not shown, made in the wiring board 1 and fixed thereto by means of a locking means not shown.

Figure 3C:
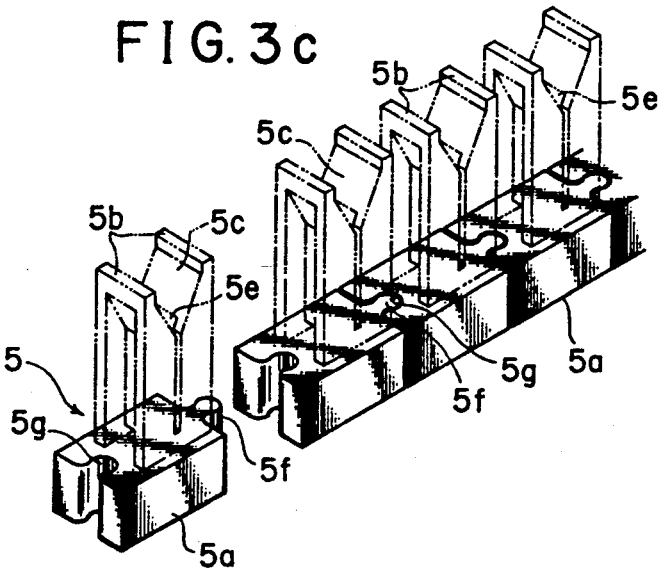
FIG. 3*c* is a perspective view showing another embodiment of the wire clamp.

As another means for arranging the wire clamps 5 in the form of a chain, the plurality of pair of fastening members 5*b*, 5*b* may be formed into an integral part, or a projected portion 5*f* may be provided on one side of the base protion 5*a* and a recessed portion 5*g* may be formed on the other side of the same as shown in FIG. 3C and the projected portion 5*f* may be engaged with the recessed portion 5*f* of the adjoining base portion. Then, the use of the support bar 6 may be eliminated. Incidentally, the clamp chain 4 need not always be arranged along the total length of the wiring board 1, but is only required to be arranged at the portion necessary for locking the wires.

Figure 4A:
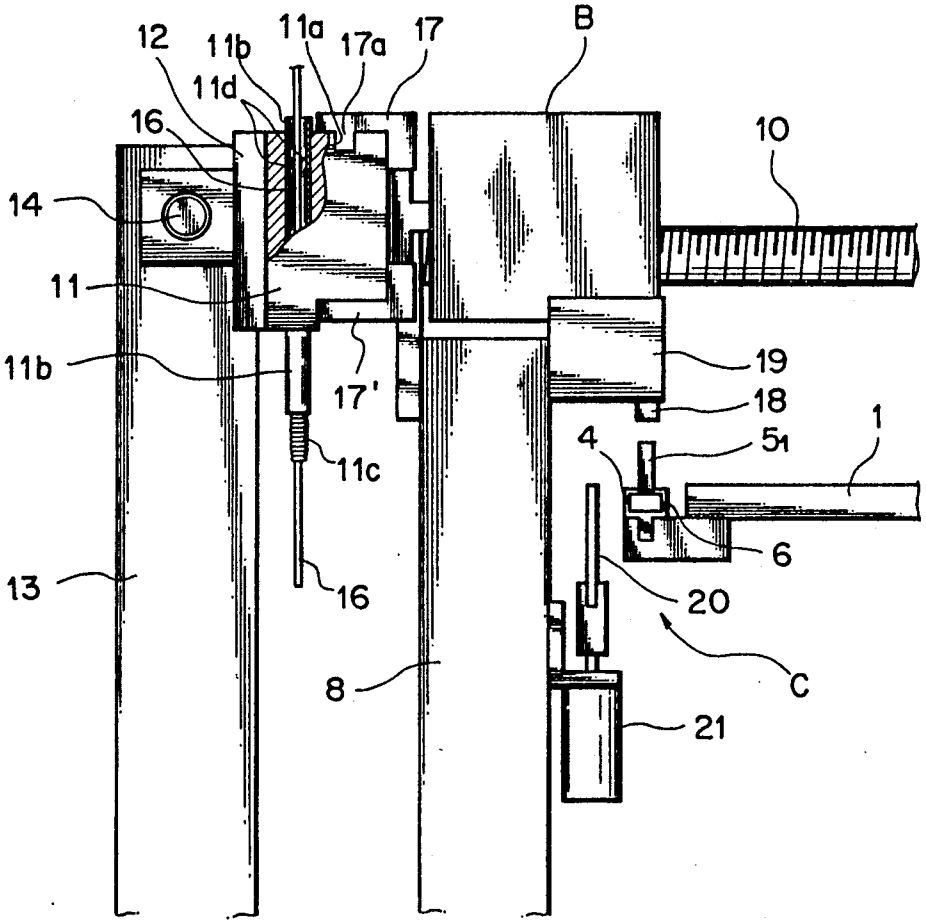
FIGS. 4*a* to 4*c* are drawings related with each other for showing states of laying a wire from start point to end point as seen from one end face of a wiring board 1.
Figure 4B:
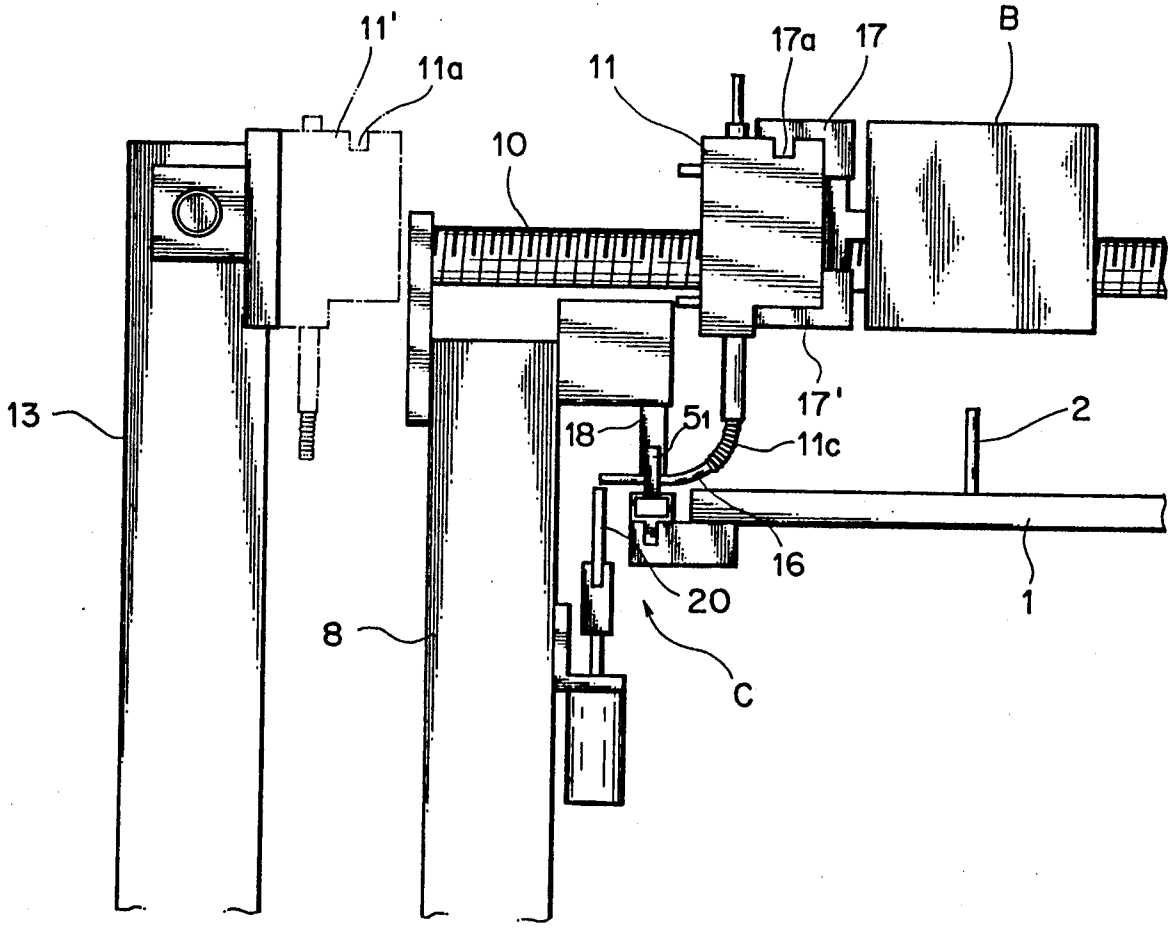
Figure 4C:
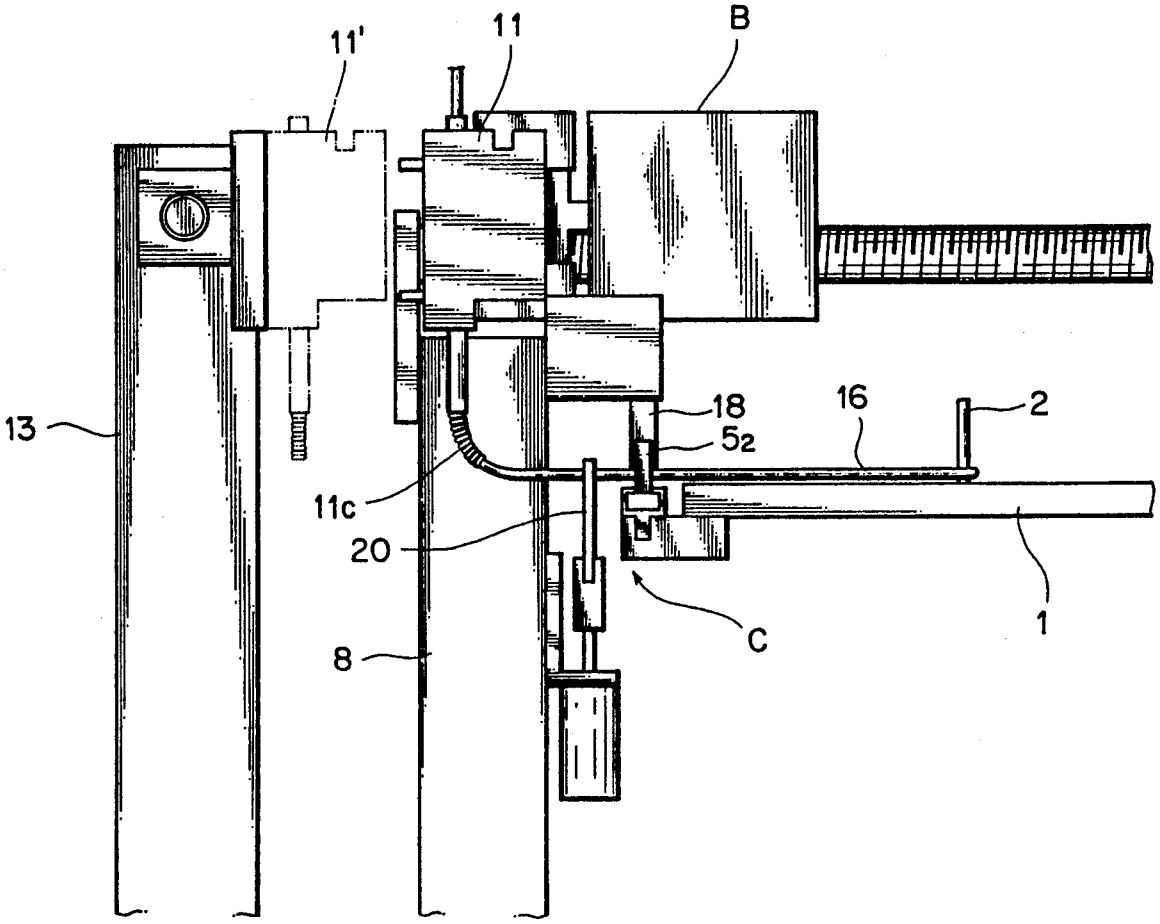

FIG. 4*a* to FIG. 4*c* are drawings showing relative positions of the wiring head B, the wire locking and cutting devices C and the wire holder 11 seen from the end face of the wiring board 1.

In these drawings, the wiring head B has a pair of clamp plates 17, 17′ opening and closing in the vertical direction against a wire holder 11. The upper clamp plate 17 is provided with an engagement pin 17*a* to be fitted into a recess hole 11*a* made in the wire holder 11. The wire holder 11 is provided with a vertical wire passing pipe 11*b* having a wire presser spring 11*d* provided therein, and at the front end portion of the pipe 11*b*, there is provided a wiring nozzle 11*c* made of a coil spring.

The wire locking and cutting device C is formed of a wire presser plate 18 attached to the upper portion of the safety guide 8 in confronted relation with the clamp chain 4 and a pair of wire cutting pieces 20 on the left and right. Reference numeral 19 denotes a fixing head including an actuator (not shown) such as an oil cylinder and the wire presser plate 18 is vertically movable. The wire cutting blades 20 are rendered capable of ascending and descending as well as opening and closing by means of a fixing head 21 including a known crank mechanism.

Manufacture of a wire harness by laying, locking, and cutting wires will be described below.

As shown in FIG. 4*a*, the controlled-rotation motor M″ rotates in either positive or reverse direction according to a command from the control J (J′), and by the resultant controlled rotation of the ball-screw shaft 14, a desired wire holder 11 is selected and moves toward where the clamp plates 17, 17′ of the wiring head B face weach other. At the same time, the wiring head B travels along Y-axis toward the side of the wire holder 11 as a result of rotation of the controlled-rotation motor M′ and thereby clamps the selected wire holder 11 by means of the clamp plates 17, 17′. Further, the wiring board 1 moves in the direction of X-axis as a result of rotation of the controlled-rotation motor M until it reaches where a desired wire clamp $5_1$ (refer to FIG. 1*a*) opposes the wire holder 11. This state will be called as "start point".

Laying Wires (1) As shown in FIG. 4*b*, the wiring head B moves to the right in the drawing relative to the wiring board 1, whereby the end portion of a wire 16 is pulled to come where it bestrides the pair of fastening members 5*b*, 5*b* of the wire clamp $5_1$, whereupon the presser plate 18 descends to press the end portion in between the members and to lock it to the same.

The pressing down of the wire along the fastening member 5*b* is smoothly carried out by the slanted guiding face 5*c*. Further, the wire is locked by means of the projected strip 5*d* and the groove 5*e* formed on the confronting faces of the fastening members 5*b*, whereby coming off or slipping of the wire while the wiring work can be positively prevented.

(2) After pressing in and locking of the wire, the wiring board 1 and the wiring head B perform simultaneous traveling along X-axis and along Y-axis by command of the control j (J′). In this way, the wire 16 is laid in a specific pattern turning at the plurality of pins 2 (refer to FIG. 1*a*).

In the wiring operation, since the wire holder 11 is provided with a wiring nozzle 11*c* made of a coil spring, the wire is smoothly pulled and any deformation of the wire such as a bent is produced.

(3) The wire 16 after being laid down is positioned astride the selected second wire clamps $5_2$ as shown in FIG. 4*c*. At this point, the wiring head B and the wiring board 1 stop their traveling and one process of wiring is finished.

The wire presser plate 18 presses the wire 16 in between the wire clamps $5_2$ in the same way as above to lock it in place, whereupon a pair of cutting blades 20 ascend to cut the wire.

This state will be called "end point".

(4) At the "end point", if it is necessary to change the kind of the wire to be laid, then the apparatus resumes the preparation step to attain the aforesaid "start point". If there is no need therefor, the wiring board 1 just moves back to (1) above (i.e., only selects a new clamp 5) and sequentially proceeds to (4). By repeating such processes, a wire harness having a desired pattern is obtained.

The wiring board 1 on which the laying of wires is finished is, in the instance of the apparatus as shown in FIG. 2*a*, is disengaged from the ball-screw shaft 9 and transferred along the rail stand A to the station Q, where the ends of the wires are straightened and then subjected to such treatments as stripping, sensing of exposed conductor, and press-joining with terminal materials.

Straightening Wires

The wire locked to the clamp chain 4 is frequently bent at its end portion as a result of locking and cutting processing. Since such a bent prevents the end from being smoothly press-joined with a terminal material, the wires are subjected to the straightening treatment in the wire straightening device E, and thereafter, they are subjected to the treatment to remove insulating covering in the stripping device F. To keep the lengths of the exposed conductors uniform, trimming may preferably be carried out simultaneously.

Press-joining Wires with Terminal Material

The wires straightened and stripped are discretely transported along the transport stand A with the movement of the wiring board 1 and subjected to the detection of degree of exposure of the conductor by a sensor (not shown) in the sensing device G and the terminal press-joining processing in the terminal press-joining device H, and thereafter, to the mounting processing of the connector housing in the case mounting device I.

Since known devices can be easily utilized for the devices G to I, explanation thereof will be omitted.

Removing Wire Harness

After mounting of the connector housings, or after press-joining of the terminal materials, the wiring board 1 is transferred to the station R, where the laid wires are wound by tapes at their important positions $U_1$, $U_2$, . . . and then removed from the wiring pins 2. Thus, a completed wire harness is obtained.

Removing Clamp Chain

When the terminal processing operation on the wires is omitted in the apparatus as shown in FIG. 2*b*, the clamp chain 4 is removed from the wiring board 1 after tapes have been wound around wires, as shown in FIG. 1*a*, at important portions $U_1$, $U_2$, . . . of the wire harness finished with the wiring on the wiring board 1. And the removed clamp chain 4 is mounted on the mount 22 as shown in FIG. 1*b* for being kept in stock until it is subjected to necessary terminal processing as described above.

So far an example wherein wires are laid by cooperation of the wiring board 1 traveling along X-axis and the wiring head B traveling along Y-axis has been described, but the wire laying can of course be carried out in accordance with the known example (specification of U.S. Pat. No. 4,476,629) in which the wiring head B makes X-Y axial traveling over the stationary wiring board 1. In such an instance, the wiring head making X-Y axial traveling may be adapted either to selectively clamp a wire holder 11 in the same manner as in the above described embodiment or to include a plurality of wire holders 11 therein and to lower and raise a desired wire holder selected out of these.

Figure 5A:
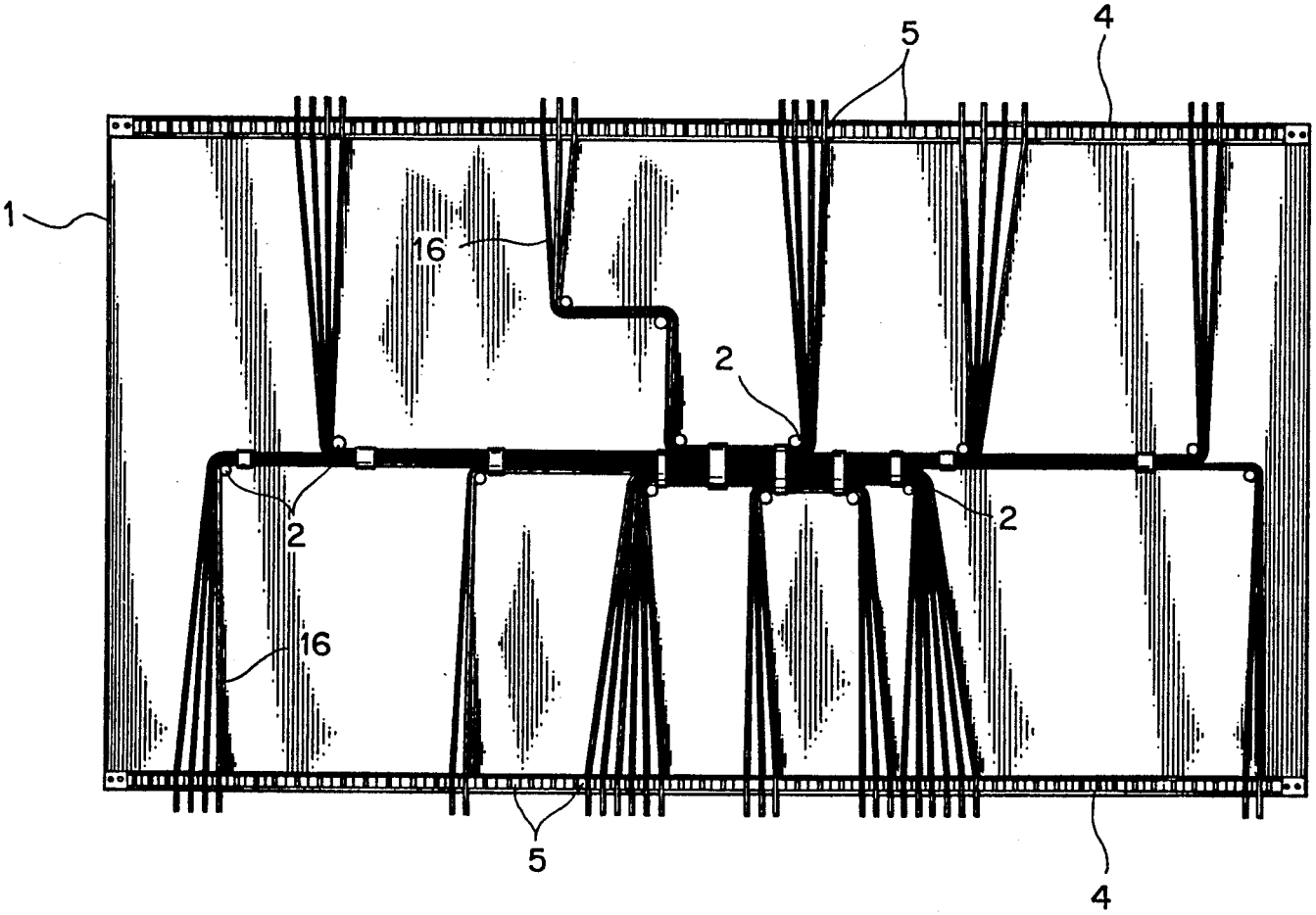
FIG. 5*a* and 5*b* are explanatory drawings showing other styles of the wire harness manufactured through the method of the present invention.
Figure 5B:
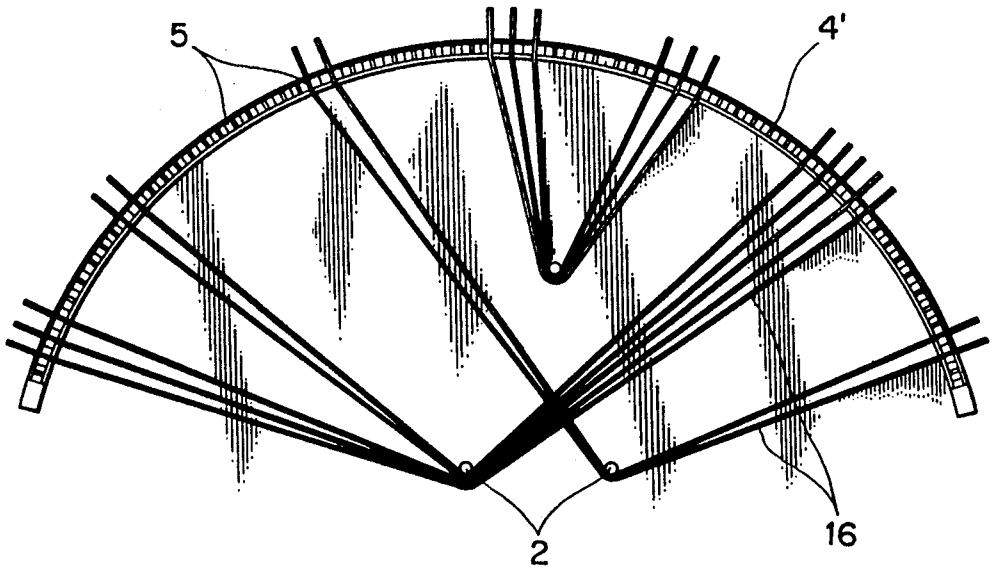

Also, as easily thought of, the clamp chain 4 for locking the wires can be provided on the edge portion at both sides of the wiring board 1 as shown in FIG. 5*a*. In this instance, the terminal processing for the wires can be speeded up. Further, when the wiring head making X-Y axial traveling is used, the clamp chain 4 needs not necessarily be made in the form of a straight line as shown in FIG. 1 or FIG. 5*a*, but it may be made in a curved or bent form such as a semicircular form 4' as shown in FIG. 5*a* (or a V-form) with the wire clamps arranged in parallel. Furthermore, the above described projected portion 5*f* and the recessed portion 5*g* provided on the base portion 5*a* of the wire clamps 5 may be adapted to rotatably engage with each other so that the clamp chain with the wire clamps 5 adjoining each other may become flexible. In such a case, the clamp chain 4 can be transported along the endless transport rail stand A enabling the processes as the terminal processing after the wires have been laid down to be carried out continuously and quickly.

Effects of the Invention

The wire harness according to the present invention is arranged such that the ends of the wires forming the wire harness are all projecting in one direction from the wire clamps formed into a chain and also held thereby at predetermined pitches and, in addition thereto, the wire harness is adapted to be removed from the wiring board as it is in the above described state.

Hence, the wire harnesses can be removed from the wiring board as they are and kept in stock for future use, and according to the need, they can be subjected to such processing as stripping and press-joining with terminal materials. Thus, the laying of the wires can be carried out without stopping it for carrying out the terminal processing and hence productivity can be improved.

Further, since the ends of the wires are all arranged on one side, by transferring the wiring board to other stations after the laying of the wires has been finished, it is made possible to make such processing as stripping the wires and press-joining them with terminal materials each by one single device, and all the processes inclusive of the mounting of the connector housings can be automated. Since only small number of processing devices are required, the cost for equipment is kept low and maintenance control of it is easy. Even when the specification of the harness is changed, it can be immediately coped with by changing the pin positions and provision in advance of the programs to be input to the control. For these reasons, the manufacturing cost of wire harnesses can be greatly reduced.

Besides, by limiting the traveling of the wiring head only to one direction along Y-axis, the arrangement of the wiring head and the wire supply mechanism can be simplified and the selection of the kind of the wire to be laid down can be facilitated. In addition thereto, differing from the prior art wiring head of the X-Y axial traveling type, there is left a larger open space on the wiring board and operation can therefore be performed in safety.

What is claimed is:

1. A method of manufacturing a wiring harness assembly which comprises:

providing a wiring harness board;

detachably attaching a chain, comprising a single support bar and a plurality of wire clamps juxtaposed each other in a line at predetermined pitches on said support bar, to said wiring harness board;

laying a first electric wire end portion in a preselected one of said clamps;

laying the other end portion of said first electric wire in another preselected one of said clamps;

locking said first electric wire end portions in said clamps, respectively;

similarly laying the end portions of at least one additional electric wire in preselected clamps;

locking said additional end portions in said clamps whereby to form a multiplicity of said wires with only said end portions being held in substantially parallel relationship at predetermined pitches with respect to each other in said preselected clamps;

processing the ends of said wires;

detaching said clamp chain, with said wires with processed ends clamped thereto, from said board;

storing said clamp chain and clamped wires without substantially changing the relationship therebetween;

removing said clamp chain and clamped wires from storage, and attaching such to a support; and thereafter subjecting said wire ends to further processing.

2. The method as claimed in claim 1 wherein said wires are laid in said clamps by means of the operation of a wiring head travelling along the X and the Y axes of said wiring board.

3. The method as claimed in claim 2 wherein said X-axis is substantially parallel to said chain and said Y-axis is substantially perpendicular thereto.

4. The method as claimed in claim 1 including stripping insulation from the ends of said wires after such have been locked in said clamps.

5. The method as claimed in claim 1 including the further steps of, after locking said multiplicity of electric wire end portions in said clamps attached to said wire board, and without removing said wire end portions from said clamps, detaching said clamp chain and its clamped wires from said wire board; storing such; then, at a later time, reattaching said chain to a wire board; and performing at least one function on said wire ends.

6. The method as claimed in claim 5 wherein said function includes stripping insulation from at least some of said wire end portions.

7. The method as claimed in claim 6 including manufacturing and storing a multiplicity of said wire harness assemblies.

* * * * *